US006007119A

United States Patent [19]

Roth et al.

[11] Patent Number: 6,007,119

[45] Date of Patent: Dec. 28, 1999

[54] MULTI-DIRECTIONAL SELF-ALIGNING SHEAR TYPE ELECTROMAGNETIC LOCK

[75] Inventors: Thomas E. Roth; Vincent J. Fralliccciardi, both of Reno, Nev.

[73] Assignee: Securitron Magnalock Corp., Sparks, Nev.

[21] Appl. No.: 08/944,991

[22] Filed: Oct. 6, 1997

[51] Int. Cl.[6] ..... E05C 19/16

[52] U.S. Cl. ..... 292/251.5; 292/DIG. 55; 292/DIG. 53; 292/DIG. 61

[58] Field of Search ..... 292/144, 251.5, 292/341.16, DIG. 61, DIG. 53, DIG. 55

[56] References Cited

U.S. PATENT DOCUMENTS

| | | | |
|---|---|---|---|
| 2,381,075 | 8/1945 | Nelsen . | |
| 2,815,235 | 12/1957 | Teetor . | |
| 3,354,581 | 11/1967 | Dimmitt . | |
| 4,439,808 | 3/1984 | Gillham . | |
| 4,487,439 | 12/1984 | McFadden . | |
| 4,562,665 | 1/1986 | Blackston | 49/44 |
| 4,826,223 | 5/1989 | Geringer et al. . | |
| 4,840,411 | 6/1989 | Sowersby . | |
| 4,941,235 | 7/1990 | Aoki | 24/303 |
| 4,981,312 | 1/1991 | Frolov | 292/251.5 |
| 4,986,581 | 1/1991 | Geringer | 292/251.5 |
| 5,000,497 | 3/1991 | Geringer et al. . | |
| 5,016,929 | 5/1991 | Frolov . | |
| 5,033,779 | 7/1991 | Geringer et al. . | |
| 5,141,271 | 8/1992 | Geringer et al. . | |
| 5,184,855 | 2/1993 | Waltz et al. . | |
| 5,184,856 | 2/1993 | Waltz . | |
| 5,261,713 | 11/1993 | Fischbach . | |

FOREIGN PATENT DOCUMENTS

| | | | |
|---|---|---|---|
| 0 351 802 A2 | 7/1989 | European Pat. Off. | E05C 19/16 |
| 2 281 096 | 2/1995 | United Kingdom | E05C 19/16 |

*Primary Examiner*—Steven Meyers
*Assistant Examiner*—Gary Estremsky
*Attorney, Agent, or Firm*—Oppenheimer Wolff & Donnelly LLP

[57] ABSTRACT

A shear-type electromagnetic lock is disclosed whose armature can approach the electromagnet from any transverse direction, which can be mounted in any orientation with respect to gravity, and which does not require any door position sensing means. The armature includes a pair of standoffs in the form of conically projecting buttons affixed thereto, the buttons projecting from the plane of contact between the armature and the electromagnet. The buttons have a base angle of 60–80 degrees adjacent the armature, and an angle of 45 degrees distal from the armature, and terminate in a smoothly rounded point. The armature is mounted to a sub-plate via counteracting springs such that the armature "floats" on the sub-plate, with the distance between the armature and the sub-plate being adjustable via adjusting screws. A matching electromagnet assembly for mounting to a door frame includes matching conical depressions positionally corresponding to the conical buttons such that the buttons seat into the depressions when the armature and electromagnet are properly aligned. The buttons and recesses are arranged in a staggered pattern.

16 Claims, 5 Drawing Sheets

10
14
16
22
24
26
28
36
38

MULTI-DIRECTIONAL SELF-ALIGNING SHEAR TYPE ELECTROMAGNETIC LOCK

FIELD OF THE INVENTION

This invention relates to the field of electromagnetic door locks, and more particularly to the field of shear-type electromagnetic locks.

BACKGROUND OF THE INVENTION

"Conventional" electromagnetic locks mount with the face of the electromagnet co-planar with that of the door. The electromagnet body mounts on the door frame with an armature plate mounted to the door. When the door closes, the armature plate abuts directly against the face of the electromagnet, and an electromagnetic force secures the door. Within the industry, this is sometimes referred to as a "direct pull" electromagnetic lock.

A second more specialized electromagnetic lock also exists called a "shear lock". With this type of lock, the face of the electromagnet is perpendicular to the plane of the door. When the armature plate is secured to the electromagnet, an attempt to open the door results in a sliding force being applied to the electromagnetic bond. Such a door securing technique has two advantages over conventionally mounted electromagnetic locks: the door can still swing in both directions which is required for double acting or revolving doors, and the lock can be completely concealed in the door and door frame which is more aesthetically pleasing.

Shear locks are intrinsically more complex than conventional electromagnetic locks for several reasons. First, electromagnetic force acting in shear is insufficient to secure a door so it must be aided by some means of mechanical engagement. Second, the armature plate must be allowed to move towards and away from the electromagnet so as to first secure and then to decouple the mechanical engagement means. Third, the shear lock system must generally include a door position detection means and often a timer to ensure that the electromagnet is only energized when the door is positioned accurately in a fully closed position.

To amplify this last point, in a conventional magnetic lock installation an external control switch will release power to the electromagnetic lock for entry or exit. The external switch may be operated momentarily or may have a time delay associated with it. In either case if the switch recloses (restoring power to the electromagnet) prior to the door reclosing, the lock will still operate correctly in that it will automatically relock the door when the door does reclose. This automatic relocking occurs when the armature plate slaps against the electromagnet face.

Prior shear locks, however, cannot be re-energized before the door has settled into its final and fully closed position. As the specification of U.S. Pat. No. 5,141,271 issued to Geringer explains, "Energizing the electromagnet before proper armature alignment can cause improper locking or non-locking of the door." This is because as the armature begins to move under the electromagnet, a portion of the armature will be attracted prematurely to the electromagnet face. This partial coupling of the armature and electromagnet will not engage the mechanical engagement means and the door will be awkwardly in an "in between" state, i.e., in a position that is not open but is not fully closed. It is certainly not properly locked but, to the end user, it feels stuck in a partially open position. The end user may leave the door in such a "partially locked" state in which case the door will not be secure. In such a case the user may feel that the lock has failed and contact his supplier for a replacement.

Another early shear lock is disclosed in U.S. Pat. No. 4,487,439 issued to McFadden. This shear lock sought to deal with the problem of incomplete/improper locking by pre-tilting the angle of the armature plate via the action of a spring as shown in FIG. 6 of the patent. This would, in theory, move the edge of the armature plate away from the electromagnet as the door is closing and thereby avoid that edge being attracted early to the electromagnet body. However, this design did not prove commercially practical largely owing to the lack of positional and movement precision that is inherent in ordinary doors. The slight tilt that could be attained was not sufficient to suppress improper "early" engagement of the armature to the electromagnet. It is believed that the owner of the McFadden patent, Dynametric, Inc., sold its designs to Von Duprin Inc. in the mid 1980's. Von Duprin has released commercial shear locks since that time without the tilting feature. An example of a Von Duprin design without the tilting feature is disclosed in Von Duprin's subsequent patent, U.S. Pat. No. 5,184,855 issued to Waltz. This patent relies upon a door position sensing means to avoid improper locking.

Prior art shear locks, other than the unsuccessful McFadden design, included door position sensing means which, through various control circuits, inhibit the electromagnet from energizing until the door is in its proper closed position. An example is U.S. Pat. No. 4,439,808 issued to Gillham, which discloses "means preferably include a proximity switch to provide an indication when the two relatively movable members are not in the predetermined relative position. This prevents false locking . . . " A number of other prior art patents focus on other novel aspects of shear lock design without addressing the requirement for door position sensing, although the door position sensing feature exists in corresponding commercial product designs.

Door position sensing does not, however, always work satisfactorily for a number of reasons. First, doors are not precision devices. Second, the most common door position sensing means is via a proximity switch consisting of a reed switch and a permanent magnet. This type of position sensing maintains an accuracy of only about plus or minus ⅛ inch (about 0.32 cm). Accordingly, the clear possibility exists that the door will still improperly lock owing to the limited accuracy of typical door position sensing means.

A common approach in prior shear locks is to incorporate a timer into the lock control circuitry. As the door recloses, the door position sensing means detects that the door is nearly in the closed position and activates a timer which is typically set for a few seconds. The timer maintains the lock in its de-energized condition. This brief delay is hoped to be sufficient for the door to settle into its proper closed position. After the delay, the lock is re-energized. This technique can fail if the door fails to find a proper closed position. This risk is greatest with a swing through or double acting door; however, that type of door constitutes a prime use for shear locks. Even on conventional doors, such factors as air pressure differentials and aging door closers commonly prevent doors from closing accurately. Another failure mechanism is if the door is moved by a person just as the control timer is timing out. The door may then become "partially locked" as described earlier. While it may seem that the chance of someone attempting to use the door just as the lock delay is timing out would be remote, electromagnetic locks—either conventional or shear—have long operating lives and may be used hundreds of times each day so even rare functional failures present a significant problem to the end user.

A second limitation of prior shear locks is "position sensitivity". Prior shear locks were designed such that the armature plate is mounted beneath the electromagnet. When the lock is de-energized, gravity plays a crucial role in separating the armature plate from the electromagnet. The present invention can be mounted with the armature beneath the electromagnet or with the electromagnet and armature facing each other on the vertical portion of the door frame and door. This is particularly useful as the end user can mount the lock half way up the vertical door frame at about 3 ½ feet above the floor. This is the same position where the door knob or door lever handle is mounted. In this position the proximity of the lock to the door knob position gives an impression of the door being tightly locked to someone pulling or pushing on the knob. When the lock is mounted at the top of the door as is the case with prior shear locks, pulling or pushing on the door knob causes the door to flex, giving an impression of low security. Such flexing, when continued over a long period of time, can also permanently bend the door.

Additionally, prior shear locks cannot be used in a specialized application: electric sliding doors with emergency push-out release. Such doors are often found in supermarkets. Ordinarily, such doors slide open to admit customers when they are triggered by a motion sensor or pressure mat. In a fire or other emergency, however, power could be lost and the doors would no longer slide open to permit evacuation. Such doors therefore include an emergency "push out" capability whereby a person needing to escape in a panic situation can push the doors open without the need to apply heavy force. This makes the doors insecure against break in. To overcome that weakness, the doors are generally mechanically locked after hours; however, many owners of such door would prefer electric locking. It is believed that to date no electric lock has been able to provide the desired dual motion of "sliding/push-out" doors.

SUMMARY OF THE INVENTION

The present invention yields an improved shear type electromagnetic lock which self aligns into proper locking position whether or not the electromagnet has been energized while the door is still open. The invention accordingly dispenses with the need for additional components to detect the door position. As an additional feature, the lock components may be mounted at the top, side or bottom of a door, i.e., in any orientation. As a still further feature, the invention successfully secures sliding/push-out doors via electro mechanical locking action.

According to the present invention, an armature in a shear type electromagnetic lock "floats" on a pair of opposed springs. The armature is fitted with standoffs which keep the armature physically separated from the electromagnet as the armature moves transversally toward the electromagnet. As long as the armature is not aligned with the electromagnet, the physical separation caused by the standoffs prevents the armature from locking to the electromagnet, even when the electromagnet is re-energized while the door has not yet closed. When the armature and electromagnet are properly aligned, the standoffs also properly align with corresponding recesses in the electromagnet assembly. The standoffs "fall" into the recesses, allowing the armature to abut against the electromagnet for locking engagement thereto.

In a preferred embodiment used for illustration purposes herein, the electromagnet is mounted in a door frame and the armature is mounted in a door. The electromagnet, which is by itself well known in the art, comprises an elongated core of E-shaped cross section with the coil encircling the center leg of the "E". Flat metal projections at each end of the electromagnet have conical depressions machined in them at diagonally opposed corners. Farther out from the conical depressions are mounting holes by which the electromagnet is secured to the door frame.

The armature assembly consists of a sub-plate which attaches to the inside of the door via suitable brackets. The sub-plate also carries the armature plate fabricated from ferrous metal. The armature plate is maintained in floating condition off the sub-plate via an arrangement of screws and opposing springs that bias the armature to "float" in a position co-planar to the sub-plate. The armature plate carries the conical projecting standoffs, which take the form of conical "buttons", on diagonally opposed ends.

In operation, the armature assembly slides transversally underneath the electromagnet as the door is closing. Even when the electromagnet is energized, the conical projecting buttons on the armature plate prevent the armature plate from coupling to the electromagnet surface until both conical projecting buttons are aligned over the matching conical depressions on the metal projections at either end of the electromagnet. When this alignment occurs, the conical projecting buttons seat themselves into the conical depressions. In this position the door is secured by a combination of electromagnetic force operating in shear and the mechanical engagement between the conical projecting buttons and the matching conical depressions. Note that the diameter of the conical depressions is greater than the diameter of the conical projecting buttons. This permits a margin for alignment error between the door and door frame.

An important feature of the present invention is the specific design of the conical projecting buttons. Each conical button has two differently angled tapers. The first taper, located at the base of the button adjacent the armature plate surface, forms an angle of between 60 and 80 degrees with the surface of the armature plate. It is this 60–80 degree "shoulder" which creates the mechanical engagement with the matching machined conical depression. This section of the button provides a "ramp" in the event that someone attempts to force open the locked door, thus redirecting shear movement into separation movement and increasing the holding strength of the electromagnet. If this "shoulder angle" were close to 90 degrees, the holding force of the lock would increase but it would tend to "hang up" on de-energization of the magnet owing to the effect of residual magnetism. Note that residual magnetism and consequent poor release is a heavily acknowledged problem in prior shear locks. The present invention avoids this problem while still producing adequate holding force for the great majority of applications.

The second taper, disposed away from the armature plate, forms an angle of approximately 45 degrees with the armature plate surface. It is this more gently angled surface which allows the armature to depress slightly so as to slide under the edge of the electromagnet assembly as the armature is moved transversally relative to the electromagnet. If instead the button were to maintain a single angle of 60–80 degrees, the button would be too high and would tend to bind when it encountered the edge of the electromagnet assembly rather than sliding under the face of the assembly. If the button were to maintain a single angle of 45 degrees, the amount of mechanical engagement would be less which would adversely affect the holding force of the lock.

In summary, the shoulder maintains the 60–80 degree angle and then tapers to a 45 degree angle before terminating to a rounded point. The compound structure of the conical projecting button and matching conical depression yields the best combination of good holding force, excellent release and smooth operation as the armature slides underneath the electromagnet.

In contrast to prior shear locks, the present invention's improved technique of mechanical engagement allows the electromagnet to properly engage the armature regardless of the direction from which the armature plate approaches the electromagnet. The armature can therefore approach the electromagnet transversally from any angle within a full 360 degrees For example, the present invention can be mounted where the armature will approach the electromagnet from a first direction, and also from a second direction generally perpendicular to the first direction. The present invention can therefore accommodate "sliding/push-out" doors which incorporate two different and perpendicular directions from which the door moves into or out of a locked position with respect to the door frame. Thus, a multi-directional shear type electromagnetic lock is disclosed.

As an additional feature, the method by which the armature plate is "floated" above its sub-plate incorporates two springs acting in opposition. This makes the armature plate effectively insensitive to mounting orientation with respect to gravity. Prior shear locks generally depended on gravity to help release the armature plate from the electromagnet, with residual magnetism always threatening to interfere with proper release. With the present invention, a predictable amount of spring bias helps to break the armature plate away from the electromagnet regardless of the orientation of the lock, allowing the lock to be mounted on the top, side or bottom of a door. Adjustment screws allow the installer to "fine tune" the spring bias to compensate for gravitational bias depending on the mounting orientation.

The present invention entirely eliminates the necessity for door position sensing and associated control circuitry including timers. This not only avoids the previously discussed possible operating failures but eliminates the cost and complexity of these additional components. The present invention "self aligns" as does a conventional electromagnetic lock and will properly engage despite being energized before the door is fully closed. Indeed, the present invention helps the door to find its closed position.

The present invention can also be mounted with the electromagnet recessed into the floor with the armature plate above it. This is useful for certain types of glass doors which are locked at the bottom owing to the fact that the top and side have no room for lock mounting. This characteristic of certain glass doors is present to enhance their architectural appearance.

In one aspect, the invention is a shear-type electromagnetic lock which protects against incomplete locking, comprising: an electromagnet assembly including an electromagnet; an armature assembling comprising an armature for electromagnetic engagement with said electromagnet along a contact surface of the armature; two standoffs projecting from the armature assembly at diagonally opposed corners thereof, each standoff comprising a generally conical base portion proximal to the armature contact surface and forming a first conical angle of between approximately 60 and 80 degrees with the contact surface, a conical portion distal to the armature having a second conical angle of approximately 45 degrees with the contact surface, and a smoothly rounded tip; an arrangement of threaded fasteners and opposing pairs of springs for floating the armature an adjustable distance from the electromagnet; wherein the electromagnet assembly has first and second recesses corresponding to the standoffs such that when the armature and electromagnet are aligned the recesses receive the standoffs thereby allowing the armature to be brought into proximity with the electromagnet for locking engagement therebetween; whereby the standoffs substantially maintain at least a leading corner of the armature at least a predetermined distance of approximately 0.15 inch (0.381 cm) away from the electromagnet while the two assemblies slide relative to one another to prevent false locking therebetween until the armature is positionally aligned with the electromagnet.

In another aspect, the invention includes an electromagnetically lockable sliding/pushout door assembly comprising: a sliding door; a guide for guiding the sliding door so that the door slides along a plane generally parallel to the plane of the door; an electromagnetic lock having a first part attached to the door and a second part attached to a door frame, the two parts electromagnetically interacting to lock the door when the electromagnetic lock is energized; angled standoffs positionally staggered at opposite corners on the first part, and corresponding recesses on the second part for allowing the two parts to electromagnetically lock and mechanically engage when one part approaches the other either from a first direction or from a second direction generally perpendicular to the first direction; and a pivoting mechanism to allow the door to swing outward for emergency egress in response to a person pushing on the door.

The above-described objects of the present invention and other features and benefits of the present invention will become clear to those skilled in the art when read in conjunction with the following detailed description of a preferred illustrative embodiment and viewed in conjunction with the appended claims and attached drawings, in which like numbers refer to like elements.

DETAILED DESCRIPTION OF A PREFERRED EMBODIMENT

Figure 1:
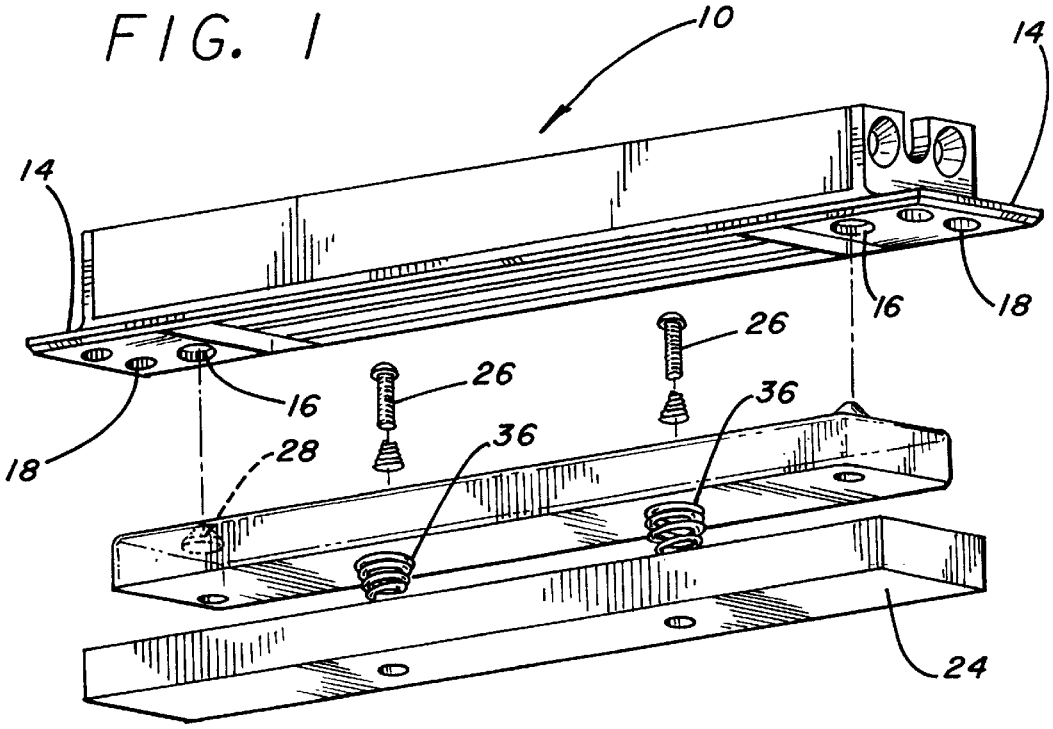
FIG. 1 is a partially exploded perspective view of the electromagnet assembly, armature, and suit of the present invention.

FIG. 1 shows the principal elements of a preferred embodiment of the present invention. The electromagnet assembly 10 includes an "E" core structure 12 such as is well known in the art, and metal projections 14 at each end. Each metal projection 14 contains a conical depression 16 and mounting holes 18. The armature assembly includes an armature 22 attached to a sub-plate 24 via fasteners such as threaded screws 26, bolts, or the like. Conical projecting buttons 28 fit into corresponding conical depressions 16 when the lock is engaged.

Figure 2:
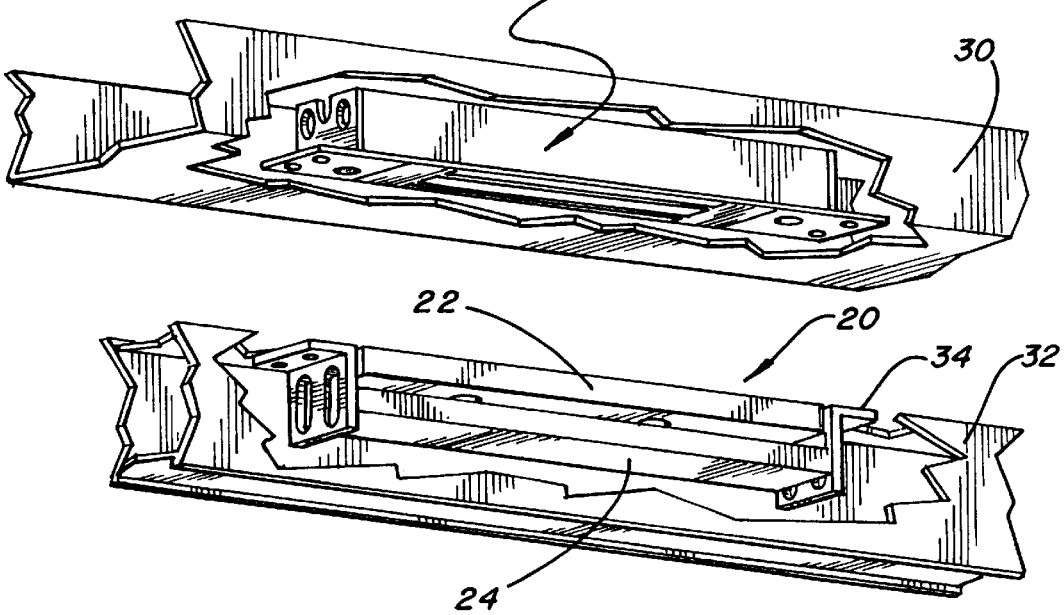
FIG. 2 is a cut-away view of the electromagnet and armature assemblies mounted in a door frame and door.

FIG. 2 shows the electromagnet and armature assembly mounted into a door frame 30 and door 32 respectively. The door frame receives the electromagnet assembly 10 affixed via screws through its mounting holes 18. Armature 22 and sub-plate 24 similarly mount into the door via suitable mounting brackets 34. Note that while other types of brackets can be devised for different door types, shear locks are generally intended for concealed mounting as shown.

Figure 3:
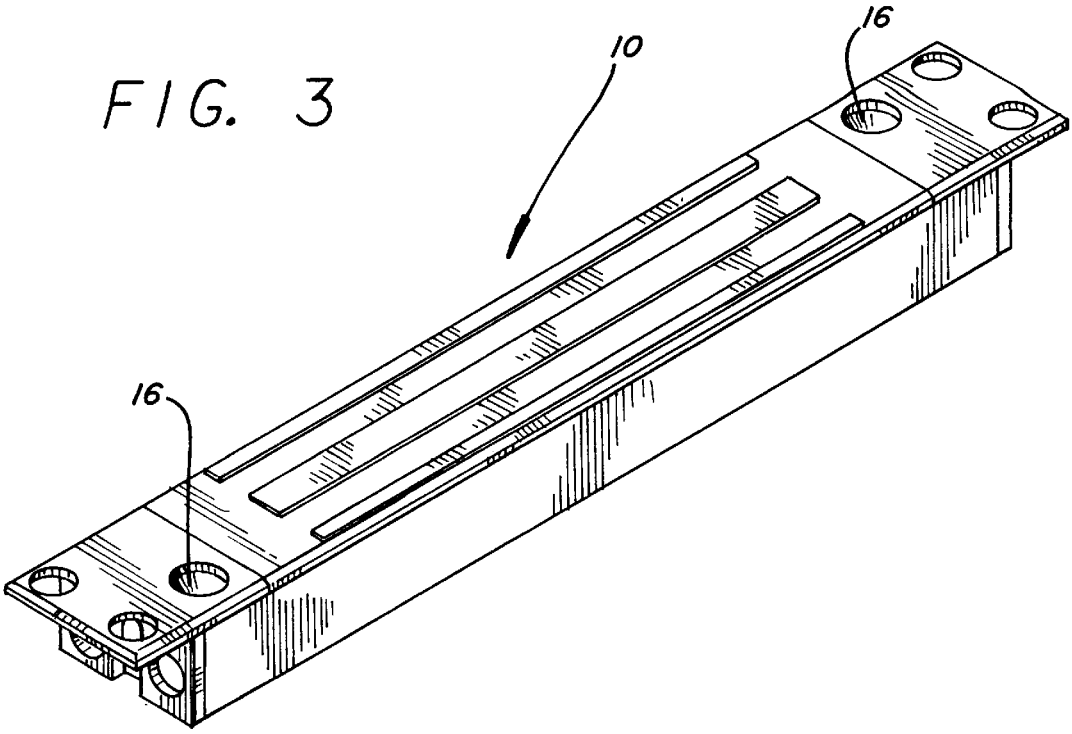
FIG. 3 is a respective view of the electromagnet assembly.

FIG. 3 is a close up view of the electromagnet assembly 10 which more clearly shows the E core construction of electromagnet 12. In the figure, conical depressions 16 have a 60–80 degree angle maintained for roughly 0.075 inch (0.1905 cm) and a 45 degree angle maintained thereafter at a position distal to the armature. It is preferred that the initial angle match the angle on the button adjacent the armature, i.e., 60–80 degrees, but it is not necessary that the depression have a second angle thereafter. Thus, the shape of the depression could be simplified, thereby saving on manufacturing costs depending on the method used to fabricate the depressions. Although one or more depressions could alternatively be formed in the electromagnet, this would reduce the electromagnet surface resulting in a corresponding loss of holding force. For this reason, the depressions are formed in a portion of the electromagnet assembly 10 other than electromagnet 12.

Figure 4:
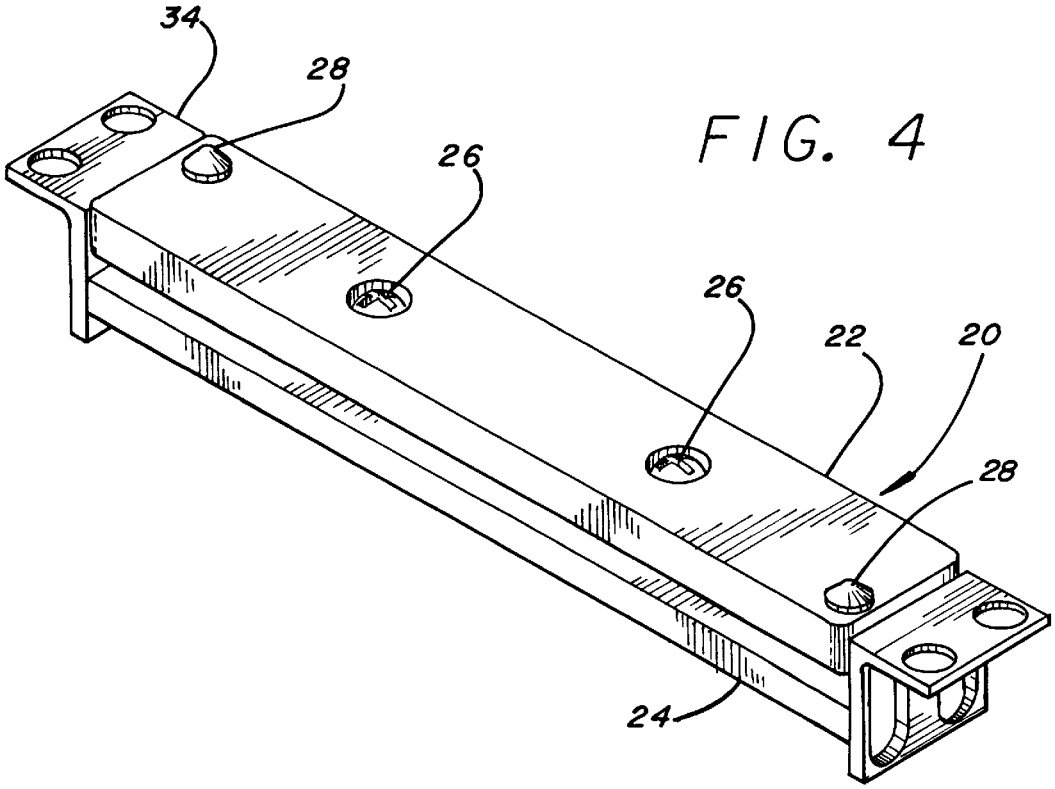
FIG. 4 is a perspective view of the armature assembly.

FIG. 4 is a close up view of the armature assembly which more clearly shows the armature 22 attached to sub-plate 24 via screws 8. Sub-plate 24 is attached to mounting brackets 34 which allow installation within a door. Each conical projecting button 28 has a stepped construction, with a 55–85 degree angle, and more preferably approximately a 60–80 degree angle, maintained for roughly 0.075 inch (0.1905 cm) at its base portion proximal to the armature; and a 20–55 degree angle, and more preferably approximately a 45 degree angle, maintained thereafter at a portion of the button distal to the armature. A relatively steep angle such as 45 degrees is preferred as it increases the height of the conical projecting buttons which in turn increases the spring bias force which seats the conical projecting buttons into the conical depressions. This improves reliability of locking. On the other hand, for certain customers a less steep angle and corresponding shorter conical projecting buttons reduces noise from the electromagnet and armature assembly as they impact each other. Thus, the precise angle chosen is a design trade-off than includes considerations of sureness of locking versus quietness of operation. Whatever the precise angle chosen for the base of the button, the angle of the corresponding portion of the recess in the electromagnet assembly preferably matches that angle. Button 28 terminates in a smoothly rounded tip.

FIG. 5 comprises four views, A–D, which display a swinging door in the final act of closing. The figure illustrates how the invention avoids early improper locking and self aligns into correct locked position. The figure also illustrates the action of the two springs in floating the armature to a correct level regardless of spatial orientation. Because armature 22 is secured but not rigidly attached by fastener 26, fastener 26 loosely secures armature 22 to sub-plate 24 and the rest of the armature assembly.

Figures 5A, 5B, 5C, 5D:
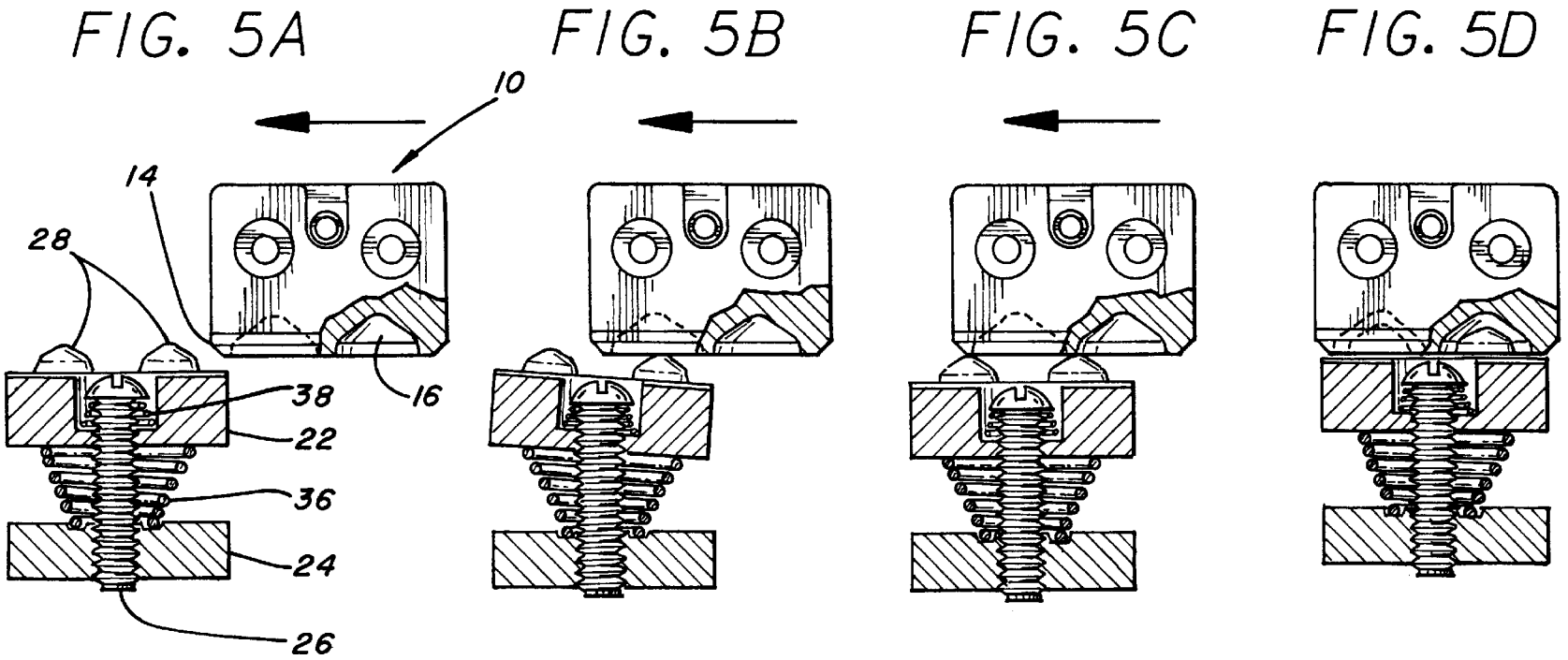
FIG. 5 is a series of partial fragmentary cross-sectional views which illustrates a swinging door closing and how the lock self aligns and engages when utilized on a swinging door.

In FIG. 5A, the swinging door is nearly closed but the armature assembly has not yet contacted the electromagnet. Armature 22 is floated to an appropriate height by the combined action of counteracting springs 36 and 38. Although gravity pulls the armature, gravity is compensated for by turning adjusting screw 26. For example, for the case in which FIG. 5A shows the armature assembly mounted at the top of a door, gravity pulls armature 22 downward toward sub-plate 24 and in so doing acts to compress large spring 36. If the armature assembly were turned on its side, gravity would be neutralized and large spring 36 would push armature 22 farther away from sub-plate 24 thereby acting to compress small spring 38. To compensate for this, screw 26 is turned so as to move the screw head closer to sub-plate 24. The adjustment is easily done at the time of installation and renders the lock generally insensitive to orientation with respect to gravity.

FIG. 5B shows the first conical projecting button contacting the side of the electromagnet metal projection 14. Armature 22 is thereby pushed downwards. Note that conical projecting button 28 does not go into the first conical depression as the depression is on the opposite side of the metal projection. Until the door is fully closed button 28 substantially maintains at least the leading corner 23 of armature 22 the desired distance away from any surface of the electromagnet. The entire leading edge will also be kept a particular distance away from the electromagnet in most cases, although this distance might not be as great along the entire length of the leading edge as for the leading corner in the embodiment shown, in which only one of the two leading corners has a standoff.

Ideally, standoff 28 is positioned at a corner of armature 22 such that the leading corner of the armature is not allowed to contact the electromagnet at all until the door is completely closed and standoffs 28 are seated into corresponding recesses 16. This would prevent any flat surface of the armature from abutting any portion of the electromagnet until the door is completely closed. However, this is not strictly necessary. In FIG. 5, for example, standoff 28 is positioned slightly rearward of the leading corner. In this embodiment, it is theoretically possible that a very narrow strip of the armature's leading edge could be drawn flat against the electromagnet if the electromagnet were turned on. In practice this will not interfere with the basic operation of the invention for two reasons. First, springs 36 and 38 will usually be sufficiently strong to prevent the total attractive force induced along this very narrow strip from drawing the armature and electromagnet together. Second, even if a very narrow strip of armature were to be drawn to the electromagnet, a person could push the door all the way open relatively easily. The door would not be in an in between state, i.e., "falsely" locked. The user would not be misled into thinking either that the door was properly locked or that the lock had malfunctioned.

Similarly, although one corner of the armature leading edge will held away from the electromagnet by the standoff, it is theoretically possible that the other corner of the leading edge will be drawn to the electromagnet. This will not realistically interfere with the operation of the invention either, because even if this were to occur the armature would still not abut flat up against the electromagnet. In such a case, the shear holding force of the lock would be small, and the door would again not be falsely locked. Thus, it is not necessary for the practice of the invention that the standoff absolutely holds a leading corner away from the electromagnet. All that is necessary is that the standoff substantially holds at least one leading corner of the armature at least a predetermined distance away from the electromagnet.

In FIG. 5C, the second projecting conical button has contacted the end of electromagnet metal projection 14. The armature is now fully spaced away from the electromagnet. Large spring 36 is compressed. The button or standoff 28 is smoothly rounded at the end so that the standoff may slide along the electromagnet assembly 10 such that the standoff holds armature 22 away from the electromagnet while the two assemblies slide relative to one another to prevent false locking therebetween in the event that the electromagnet becomes energized before the armature is brought into full alignment with the electromagnet. The total height of the button or standoff is approximately 0.187 inch (0.475 cm) in the preferred embodiment. The button therefore holds the armature a predetermined distance of at least 0.10 inch (0.254 cm), and preferably at least 0.15 inch (0.381 cm), away from the electromagnet while the two assemblies slide relative to one another until the door is fully closed, to prevent false locking therebetween.

It is to be understood in the context of the present disclosure and the appended claims that when the armature is said to be held at least a predetermined distance from the electromagnet, this means that at least one corner of the armature is held the predetermined distance from the electromagnet; it is not strictly necessary that the entire armature be held the specified distance from the electromagnet. For example, when the electromagnet is tilted due to only one button contacting the electromagnet assembly, a part of the surface of the armature may actually be closer than the specified distance to a portion of the electromagnet. This is acceptable in most instances. If desired, additional standoffs could be added in various staggered patterns as will be apparent to one skilled in the art, to ensure that every portion of the armature is maintained a specified distance from every portion of the electromagnet until the armature and electromagnet are properly aligned in a closed position.

In FIG. 5D, the armature and electromagnet are aligned in a properly closed position, and both conical projecting buttons seat in their respective conical depressions. Large springs 36 supply an upward push which, together with the electromagnetic force, couples the electromagnet and armature 22 fully together. Thus, when the armature and electromagnet are aligned the buttons 28 are received by corresponding recesses 16 thereby allowing the armature to be brought into proximity with the electromagnet, thereby allowing locking engagement therebetween. The diameter of conical depressions 16 exceeds that of conical projecting buttons 28 to allow for a certain amount of misalignment between the door and the frame.

When power to the electromagnet is withdrawn, small springs 38 provide a push which tends to release any residual magnetic bond. As pressure is applied to the door to open it, the 60–80 degree angle between the conical projecting button 28 and conical depression 16 provides a ramp effect to further assist breaking armature 22 away from electromagnet 12.

FIG. 6 comprises five views, A–E, which display a sliding door in the final act of closing. The figure illustrates how the present invention avoids early improper locking and self aligns the lock into correct locked position. The figure also illustrates the action of the two springs in floating the armature to a correct level regardless of spatial orientation.

Figures 6A, 6B, 6C, 6D, 6F:
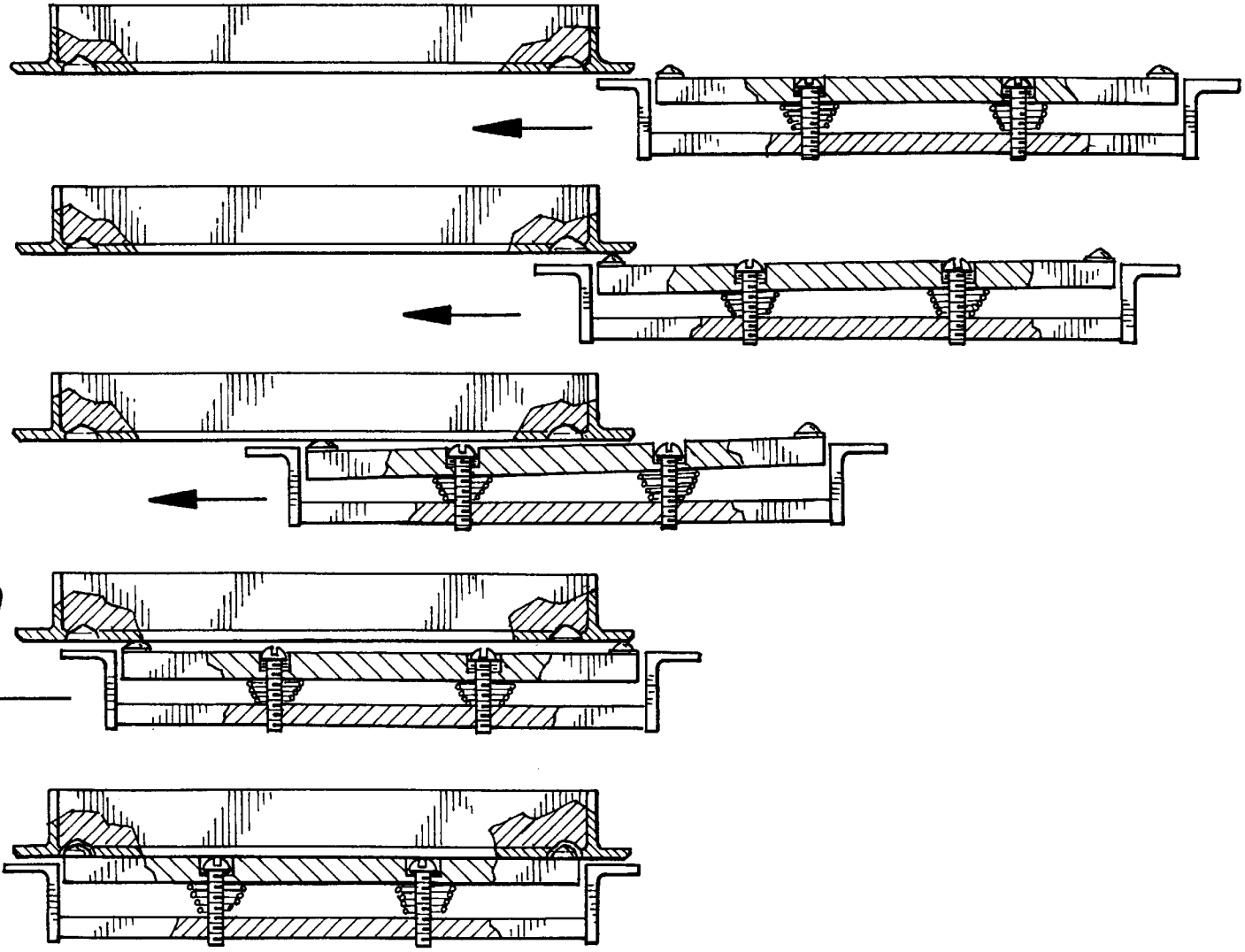
FIG. 6 is a series of partial fragmentary side elevation views which illustrates a sliding door closing and how the lock self aligns and engages when utilized on a sliding or sliding/push-out door, illustrating the action of the two springs which float the armature with respect to the sub-plate.

In FIG. 6A, the sliding door is nearing closure but the armature assembly has not yet contacted the electromagnet. Armature 22 is floated to an appropriate level by the combined action of large spring 36 and small spring 38. For example, if we consider that view A shows the armature assembly mounted at the top of a door, gravity is pulling armature 22 downward toward sub-plate 24 and in so doing is compressing large spring 36. If the armature assembly were turned on its side, gravity would be neutralized and large spring 36 would push armature 22 farther away from sub-plate 24 thereby compressing small spring 38. To compensate for this, adjusting screw 26 is turned so as to move the screw head closer to sub-plate 24. This type of adjustment is easily done at the time of installation and renders the lock independent of orientation.

FIG. 6B shows the first conical projecting button contacting the end of the electromagnet metal projection 14. Armature 22 is thereby tipped or otherwise pushed downwards. Note that the conical projecting button does not go into the first conical depression as the depression is on the opposite side of the metal projection.

FIG. 6C shows the first conical projecting button halfway across the electromagnet face. Note that the height of the button keeps the surface of armature 22 spaced away from the electromagnet surface thereby avoiding premature and improper locking.

In FIG. 6D, the second projecting conical button has contacted the end of the electromagnet metal projection 14. The armature is now fully spaced away from the electromagnet. Large spring 36 is compressed.

In FIG. 6E, both conical projecting buttons 28 are seated in their respective conical depressions 16. Large springs 36 supply an upward push which causes coupling together with the electromagnetic force. Note that the diameter of the conical depressions 16 exceeds that of conical projecting buttons 28 to allow for a certain degree of misalignment between the door and frame. Projecting buttons 28 and corresponding recesses 16 are arranged in a staggered pattern as shown in FIGS. 3 and 4, so that a single production model can be mounted in either a "short shear" configuration as in FIG. 5, a "long shear" configuration as in FIG. 6, or in a configuration utilizing both modes as in the example of FIG. 8, without a button falling into the "wrong" recess. Staggered recesses 16 are also longitudinally positioned between the legs of the "E" core electromagnet as illustrated in FIG. 3 so that when the lock moves in "long shear" as in FIG. 6, buttons 28 slide over the electromagnet assembly between the legs of the electromagnet. This prevents buttons 28 from scoring channels into the electroplating of electromagnet 12 over time, which would permit corrosion. Thus, the buttons do not contact any surface of the electromagnet, either when the lock is used in a "long shear" or a "short shear" configuration, i.e., as the armature moves relative to the electromagnet either in a first shear direction or in a second shear direction generally perpendicular to the first shear direction, or both.

When power to the electromagnet is withdrawn, small springs 36 provide a push which tends to release the bond. As pressure is applied to the door to open it, the 60–80 degree angle between conical projecting button 28 and conical depression 16 provides a ramp effect to further assist breaking armature 22 away from electromagnet 12.

Figure 7:
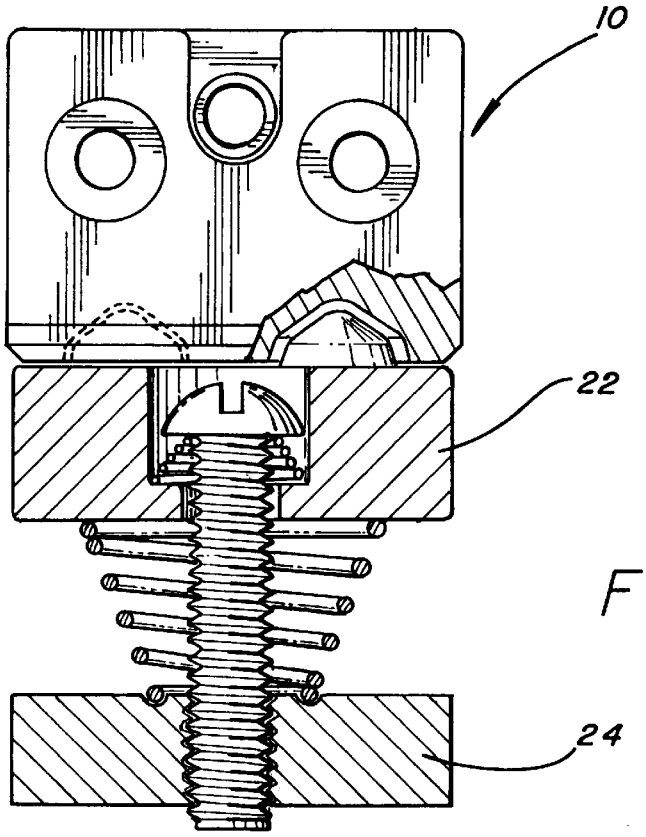
FIG. 7 is a close up partial fragmentary cross sectional view of the electromagnet, armature and sub-plate in detail the conical projecting button, conical depression, and the opposing spring.

FIG. 7 is a close-up, cross sectional view of electromagnet 12, armature 22, and sub-plate 24. The figure illustrates the shape of conical projecting buttons 28. For approximately 0.075 inch (0.1905 cm) the button proceeds from its base at an angle of 60–80 degrees. It then tapers off to 45 degrees. The conical depression matches this shape but is larger in diameter so as to provide a margin for alignment error. Opposing springs 36 and 38 work together to float the armature at an adjustable distance from the sub-plate. This distance is adjusted to compensate for gravity regardless of mounting orientation by turning adjusting screw 26.

Figure 8:
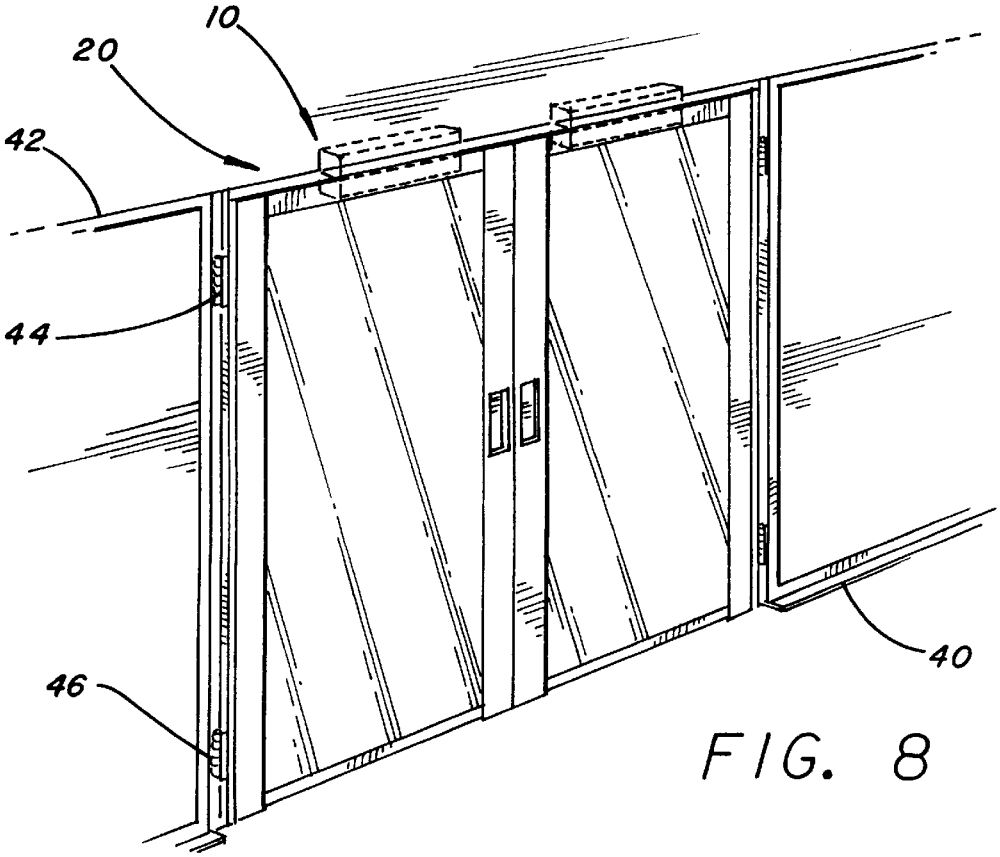
FIG. 8 is a partial fragmentary view of a door capable of dual sliding and push-out movement according to the present invention.

FIG. 8 shows a sliding/push-out door capable of being electromagnetically locked according to the present invention. Sliding doors 48 slide on top and bottom guides 40 and 42 respectively to open and close during normal operation, as for example when a user steps on a pressure plate (not shown) in front of the door. The doors slide in a plane generally parallel to the plane of the door. Each door is equipped with a multi-direction shear type lock including an electromagnet assembly 10 and an armature assembly 20 as previously described. The doors are therefore capable of sliding to a fully closed and locked position. The operation of the lock in response to the normal sliding in and out of the door is shown in FIG. 6. In the event of a power failure or other emergency, the lock is de-energized. A pivoting mechanism such as hinges 44 and 46 mounted at the top and bottom of the door respectively allow door 48 to swing outward in response to a user pushing on the door for emergency egress. The motion of the armature assembly relative to the electromagnet assembly in response to swinging movement of the door is that shown in FIG. 5. In this configuration, the door is capable of being electromagnetically locked when the door and armature approach the frame and electromagnet either from a first direction, or from a second direction generally perpendicular to the first direction.

In applications in which a door will be exposed to many cycles, the buttons and the surface on the electromagnet assembly on which they slide will also be exposed to many sliding cycles. In such an application, it may be desirable to make either the buttons or the surface on which they slide out of a material that is hard yet non-abrasive, such as polyethylene, or by coating the surface with TEFLON™ or similar material. It may also be desirable to make either the buttons or the surface on which they slide replaceable. Many ways of accomplishing these objects will be apparent to those skilled in the art. Additionally, it will be appreciated that although the buttons have been described as projecting from the armature in the foregoing description, the buttons could alternatively project from the electromagnet assembly, with corresponding recesses being located in the armature assembly. It will further be appreciated that the standoffs need not necessarily project from a ferromagnetic portion of the armature assembly. Accordingly, within the context of the disclosure and appended claims although the standoffs are said to project from the armature it is to be understood that it is not necessary that the portion of the armature assembly from which the standoffs project be ferromagnetic. Furthermore, although the recesses are generally described in the illustrative embodiment as conically shaped holes, it will be appreciated that any arrangement having a lip, drop-off, notch, slope, cutout, or any other such type of recess lies within the scope of the present invention. Still further, although the standoffs are described in the illustrative embodiment as conical projecting buttons, it is possible for the standoffs to take other shapes, such as a hemisphere for example. It is even possible, for example, that a first standoff having a flat angled surface performs the function of engaging the electromagnet to depress the armature, while a different standoff having a different angled flat surface facing the opposite direction performs the function of providing the "ramp" which increases the holding strength of the shear lock. However, the conical button having dual angled surfaces and a smoothly rounded tip is preferred overall for reasons of simplicity, ease of manufacture, independence of direction from which the two assemblies approach each other, and universal application.

The present invention is also not limited to installations in which the electromagnet is mounted in a door frame and the armature is mounted to a door. Although it is generally desirable to mount the components in such a configuration due to the fact that the electromagnet requires an electric feed, it is possible to mount the electromagnet to a door and the armature to a door frame.

Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. A shear-type electromagnetic lock which protects against incomplete locking, comprising:

an electromagnet assembly including an electromagnet:

an armature assembly comprising:

an armature for electromagnetic engagement with said electromagnet along a contact surface of the armature;

two standoffs projecting from the armature assembly at diagonally opposed corners thereof, each standoff comprising:

a generally conical base portion proximal to the armature contact surface and forming a first conical angle of between approximately 60 and 80 degrees with the contact surface;

a conical portion distal to the armature having a second conical angle of lesser degree than the first conical angle; and a smoothly rounded tip; and means for floating the armature an adjustable distance from the electromagnet;

wherein the electromagnet assembly has first and second recesses such that when the armature and electromagnet are aligned the recesses receive the standoffs thereby allowing the armature to be brought into proximity with the electromagnet for locking engagement therebetween;

whereby the standoffs maintain the armature at least a predetermined distance away from the electromagnet while the two assemblies slide relative to one another to prevent false locking therebetween until the armature is positionally aligned with the electromagnet.

2. The electromagnetic lock of claim 1 wherein:

said second conical angle is approximately 45 degrees.

3. The electromagnetic lock of claim 1 wherein said armature floating means comprises:

an adjustable fastener for loosely securing the armature to a door;

a first spring for biasing the armature toward the electromagnet; and a second spring for biasing the armature away from the electromagnet.

4. A shear-type electromagnetic lock which protects against incomplete locking, comprising:

an electromagnet assembly including an electromagnet:

an armature assembly including an armature for electromagnetic engagement with said electromagnet along a contact surface of the armature; and a first standoff projecting from one of said assemblies and positioned at a leading edge of its associated assembly, said first standoff having an angled surface defining a contact angle adapted for contacting the other of said assemblies at a leading edge thereof and forcing said assemblies to at least a predetermined separation distance away from each other, the standoff being adapted for movement along the other assembly such that the standoff holds the armature at least said predetermined distance away from the electromagnet while the two assemblies slide relative to one another to prevent false locking therebetween, said other assembly having a first recess corresponding to the first standoff such that when the armature and electromagnet are aligned the recess receives the standoff thereby allowing the armature to be brought into proximity with the electromagnet for locking engagement therebetween, wherein:

the standoff projects from the armature assembly;

the recess is located in the electromagnet assembly; and wherein the lock further comprises:

positioner means for allowing the armature to move from a neutral position both forward and back against opposing biasing force when the lock is in an unenergized position, the biasing force being provided by said positioner means and said movement being in a direction that is defined as generally perpendicular to a plane of contact between the electromagnet and the armature when the electromagnet is energized.

5. The electromagnetic lock of claim 4 wherein the standoff comprises:

a base portion adjacent the armature, the base portion forming a first angle with the armature contact surface; and a second portion distal from the armature, said second portion forming said contact angle with the armature contact surface, the contact angle being of lesser degree than the first angle yet greater than zero degrees.

6. The electromagnetic lock of claim 5 wherein:

said first angle is between approximately 55 and 85 degrees; and said contact angle is between approximately 20 and 55 degrees.

7. The electromagnetic lock of claim 6 wherein:

said first angle is between approximately 60 and 80 degrees; and said contact angle is approximately 45 degrees.

8. The electromagnetic lock of claim 6 further comprising:

a second standoff projecting from the armature assembly, said second standoff being disposed at a corner of the armature diagonally opposed from the first standoff;

and wherein the electromagnet assembly has a second recess capable of receiving the second standoff such that when the armature and electromagnet are aligned the second recess receives the second standoff.

9. The electromagnetic lock of claim 4 further comprising:

a second standoff projecting from the armature assembly, said second standoff being disposed at a corner of the armature diagonally opposed from the first standoff;

and wherein:

the electromagnet assembly has a second recess capable of receiving the second standoff such that when the armature and electromagnet are aligned the second recess receives the second standoff.

10. The electromagnetic lock of claim 4 wherein the positioner means further comprises:

a first spring for biasing the armature toward the electromagnet;

a second spring for biasing the armature away from the electromagnet; and an adjusting mechanism for adjusting the unenergized position of the armature relative to the electromagnet when the electromagnet is unenergized, whereby a user may adjust the armature position to compensate for gravitational effects in any mounting orientation of the lock.

11. The electromagnetic lock of claim 10 wherein the adjusting mechanism is an adjusting screw.

12. The electromagnetic lock of claim 4 wherein:

the first standoff is in the form of a conical projecting button.

13. An electromagnetic lock adapted to be mounted at the top, bottom, or side of a door, the electromagnetic lock comprising:

an electromagnet; and an armature assembly comprising;

a mount;

an armature for electromagnetically engaging the electromagnet; and positioner means for allowing the armature to move from a neutral position both forward and back against opposing biasing force when the lock is in an unenergized position, the biasing force being provided by said positioner means and said movement being in a direction that is defined as generally perpendicular to a plane of contact between the electromagnet and the armature when the electromagnet is energized.

14. The electromagnetic lock of claim 13 wherein:

the armature assembly further comprises:

a mounting bracket for mounting the armature assembly to a door or door frame; and a sub-plate affixed to the mounting bracket; and wherein the positioner means further comprises:

a fastener for loosely securing the armature to the sub-plate;

a first spring acting on the sub-plate and the armature for biasing the armature away from the mount; and a second spring acting on the sub-plate and the securing means for biasing the armature toward the mount.

15. The electromagnetic lock of claim 14 wherein the fastener threadingly engages the sub-plate for loosely securing the armature thereto.

16. A shear-type electromagnetic lock which protects against incomplete locking, comprising:

an electromagnet assembly including an electromagnet:

an armature assembly comprising:

an armature for electromagnetic engagement with said electromagnet along a contact surface of the armature;

two standoffs projecting from the armature assembly in a staggered pattern, each standoff comprising:

a conical base portion proximal to the armature contact surface and forming a first conical angle with the contact surface;

a conical portion distal to the armature having a second conical angle of lesser degree than the first conical angle; and an adjustable positioner for floating the armature an adjustable distance from the electromagnet;

wherein the electromagnet assembly has first and second recesses such that when the armature and electromagnet are aligned the recesses receive the standoffs thereby allowing the armature to be brought into proximity with the electromagnet for locking engagement therebetween;

whereby the standoffs maintain the armature at least a predetermined distance away from the electromagnet while the two assemblies slide relative to one another to prevent false locking therebetween until the armature is positionally aligned with the electromagnet.

* * * * *